US007210309B2

(12) United States Patent
Fukanuma et al.

(10) Patent No.: US 7,210,309 B2
(45) Date of Patent: May 1, 2007

(54) VARIABLE DISPLACEMENT COMPRESSOR

(75) Inventors: Tetsuhiko Fukanuma, Kariya (JP); Masahiro Kawaguchi, Kariya (JP); Yasuharu Odachi, Kariya (JP); Masao Iguchi, Kariya (JP); Yoichi Takashima, Kariya (JP); Kazuhito Miyagawa, Kariya (JP)

(73) Assignee: Denso Corporation (JP)

( * ) Notice: Subject to any disclaimer, the term of this patent is extended or adjusted under 35 U.S.C. 154(b) by 553 days.

(21) Appl. No.: 10/830,340

(22) Filed: Apr. 22, 2004

(65) Prior Publication Data

US 2005/0002802 A1 Jan. 6, 2005

(30) Foreign Application Priority Data

Apr. 25, 2003 (JP) ..... 2003-122970

(51) Int. Cl.
*F25B 43/02* (2006.01)

(52) U.S. Cl. ..... 62/469; 417/372

(58) Field of Classification Search ..... 62/468–469; 417/372

See application file for complete search history.

(56) References Cited

U.S. PATENT DOCUMENTS 3,039,667 A * 6/1962 Kozlik ..... 229/120.012
4,645,429 A * 2/1987 Asami et al. ..... 417/312
5,221,191 A * 6/1993 Leyderman et al. ..... 417/312
5,591,018 A * 1/1997 Takeuchi et al. ..... 417/366
6,675,596 B2 1/2004 Iwanami et al. ..... 62/236
6,675,607 B2 * 1/2004 Tarutani et al. ..... 62/469

FOREIGN PATENT DOCUMENTS

JP 2002-081375 3/2002
JP 2003-286943 10/2003

* cited by examiner

*Primary Examiner*—William E. Tapolcai
(74) *Attorney, Agent, or Firm*—Woodcock Washburn LLP

(57) ABSTRACT

A variable displacement compressor for efficiently cooling and lubricating seals arranged on a rotary shaft. The seals are arranged at end portions of the rotary shaft that project from a housing of the compressor. A first lubrication chamber is defined by a first seal in the housing around the front end portion of the rotary shaft. A second lubrication chamber is defined by a second seal in the housing around the rear end portion of the rotary shaft. A shaft passage extends through the rotary shaft to connect the first and second lubrication chambers. Refrigerant gas including lubricating oil flows from a crank chamber to a suction chamber via the first lubrication chamber, the shaft passage, and the second lubrication chamber. This efficiently cools and lubricates the seals.

20 Claims, 2 Drawing Sheets

VARIABLE DISPLACEMENT COMPRESSOR

BACKGROUND OF THE INVENTION

The present invention relates to a variable displacement compressor.

A vehicle air conditioner includes a compressor for compressing refrigerant. One type of compressor is driven by an engine and an electric motor. Japanese Laid-Open Patent Publication No. 2002-81375 describes such a compressor.

The compressor includes a housing that accommodates a compression mechanism. The housing supports the end portions of a rotary shaft in a rotatable manner. The end portions of the rotary shaft project from the compressor. The rotary shaft is used to drive the compression mechanism. A pulley connects one of the end portions projecting from the compressor to the engine. The other one of the end portions projecting from the compressor is connected to the electric motor, which is arranged outside the compressor.

Such a compressor that is connected to an electric motor arranged outside the compressor may be made more compact than a compressor that houses the electric motor therein. Further, the housing, which accommodates the compression mechanism, and the electric motor may be assembled separately and then connected to each other. This facilitates maintenance and replacement of the electric motor.

To hermetically seal the housing, seals must be arranged between the housing and the two end portions of the rotary shaft. It is preferable that the seals be lubricated and cooled to reduce friction between the seals and the rotary shaft and to improve the durability of the seals.

As known in the prior art, a seal may be arranged along a circulation path of the refrigerant in the housing to improve lubrication and cooling. However, the known compressors with seals arranged along the circulation path do not employ rotary shafts having both of their end portions projecting from the compressor. That is, in the prior art, in a compressor having a rotary shaft with only one end portion projecting from the compressor, only the projecting end portion is sealed. However, for a compressor having a rotary shaft with both of its end portions projecting from the compressor, there are no known structures that seal both end portions. Accordingly, there is a demand for a compressor that efficiently lubricates and cools the seals arranged on both projecting end portions of the rotary shaft.

SUMMARY OF THE INVENTION

One aspect of the present invention is a compressor, connected to an external refrigerant circuit, for compressing refrigerant gas. The compressor includes a first housing, a second housing, and a cylinder block having a bore. The cylinder block is arranged between the first and second housings. A piston accommodated in the bore. The piston defines a compression chamber in the bore. A rotatable rotary shaft extends through the first housing, the cylinder block, and the second housing. The rotary shaft has a first end portion and a second end portion. A crank chamber is defined in the first housing. A crank mechanism, accommodated in the crank chamber, converts rotation of the rotary shaft to reciprocation of the piston. A suction chamber, defined in the second housing, draws in refrigerant gas from the external refrigerant circuit. A first seal seals the first housing at the first end portion of the rotary shaft. A second seal seals the second housing at the second end portion of the rotary shaft. A first lubrication chamber is defined by the first seal around the first end portion of the rotary shaft in the first housing. A second lubrication chamber is defined by the second seal around the second end portion of the rotary shaft in the second housing. A shaft passage extends axially through the rotary shaft. The shaft passage is connected to the crank chamber via the first lubrication chamber and is connected to the suction chamber via the second lubricating chamber.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A variable displacement compressor (hereinafter referred to as the compressor) CP according to a first embodiment of the present invention will now be described with reference to FIG. 1. The compressor CP is used for an air conditioner of a vehicle and connected to an external refrigerant circuit 38, which forms part of a refrigerant cycle. The left side of the compressor CP as viewed in FIG. 1 is defined as the front of the compressor CP, and the right side as viewed in FIG. 1 is defined as the rear side of the compressor CP.

Figure 1:
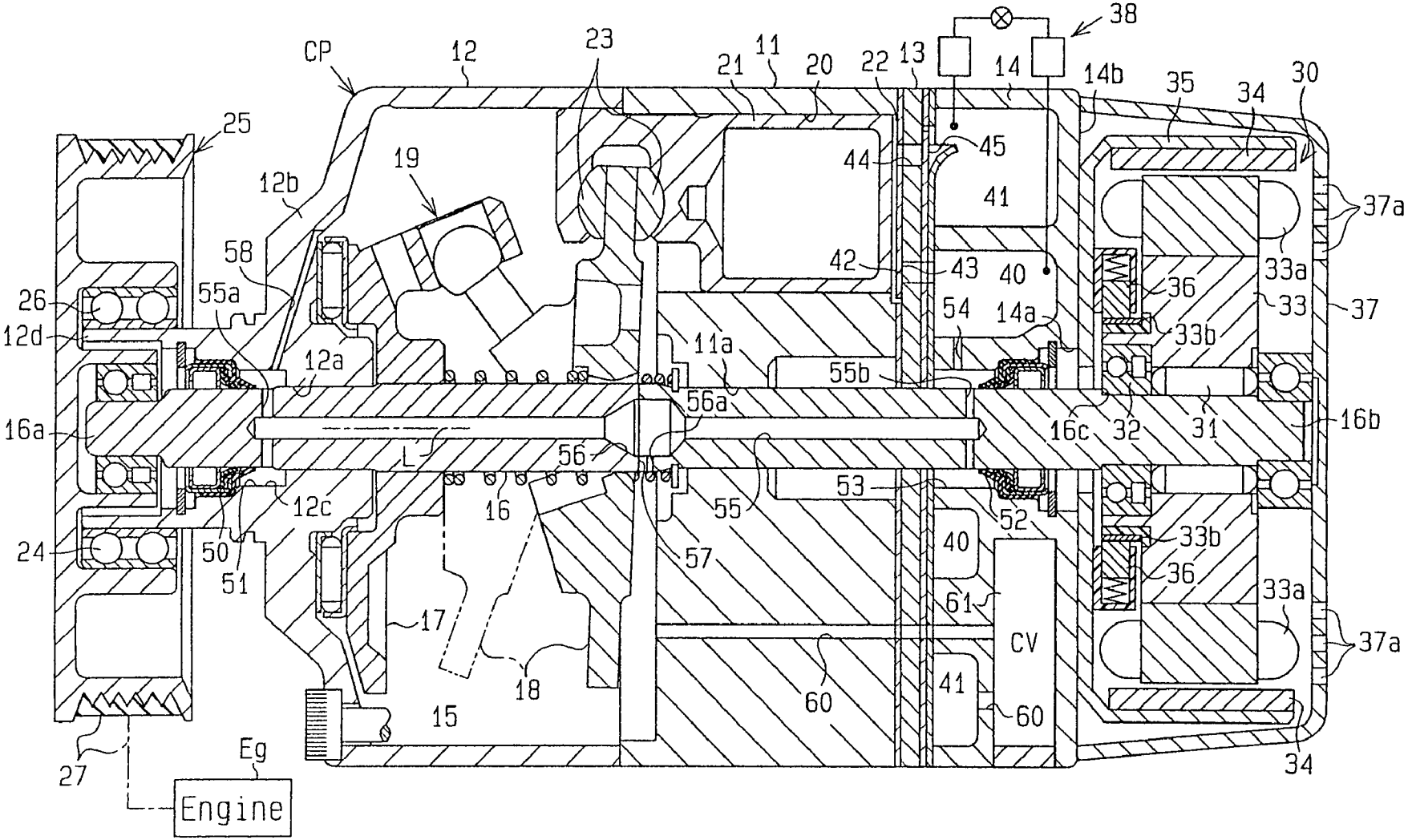
FIG. 1 is a schematic cross-sectional view of a compressor according to a preferred embodiment of the present invention.

As shown in FIG. 1, the compressor CP includes a cylinder block 11, a front housing 12 fixed to the front end of the cylinder block 11, and a rear housing 14 fixed to the rear end of the cylinder block 11 via a valve plate assembly 13.

A crank chamber 15 is defined in the front housing 12 in front of the cylinder block 11. A rotary shaft 16 extends through the crank chamber 15 and is rotatably supported by the cylinder block 11 and the front housing 12. The rotary shaft 16 is supported by slide bearing portions 11*a*, 12*a* in the cylinder block 11 and the front housing 12. A lug plate 17 is secured to the rotary shaft 16 in the crank chamber 15 and rotates integrally with the rotary shaft 16.

The crank chamber 15 accommodates a cam plate, or a swash plate 18. The swash plate 18 is supported by the rotary shaft 16 to slide along and incline with respect to the rotary shaft 16. A hinge mechanism 19 is located between the lug plate 17 and the swash plate 18 to rotate the swash plate 18 integrally with the lug plate 17 and the rotary shaft 16 while permitting the swash plate 18 to slide along the rotary shaft 16 in the direction of the rotary shaft axis L and incline with respect to the rotary shaft 16.

A plurality of cylinder bores 20 (only one shown in FIG. 1) extends through the cylinder block 11 around the rotary shaft 16. A single headed piston (hereinafter referred to as the piston) 21 is accommodated in each cylinder bore 20. Each piston 21 and the corresponding cylinder bore 20 define a compression chamber 22. Reciprocation of the piston 21 varies the volume of the compression chamber 22.

Each piston 21 is engaged with the peripheral portion of the swash plate 18 via a pair of shoes 23. Therefore, when the rotary shaft 16 rotates the swash plate 18, the rotation of the swash plate 18 is converted to the reciprocation of each piston 21. The lug plate 17, the swash plate 18, the hinge mechanism 19, and the shoes 23 define a crank mechanism for converting the rotation of the rotary shaft 16 to the reciprocation of each piston 21.

An annular suction chamber 40 and an annular discharge chamber 41 are defined in the rear housing 14 at the rear side of the cylinder block 11. A through hole 14*a* extends axially through the center of the rear housing 14. The suction chamber 40 is formed to surround the through hole 14*a*, and the discharge chamber 41 is formed to surround the suction chamber 40.

The suction chamber 40 is connected to the discharge chamber 41 via the external refrigerant circuit 38, which forms part of the refrigerant cycle. When each piston 21 moves from the top dead center position to the bottom dead center position, refrigerant gas in the suction chamber 40 is drawn into the corresponding compression chamber 22 via a corresponding suction port 42 and suction valve 43, which are formed in the valve plate assembly 13. When each piston 21 moves from the bottom dead center position to the top dead center position, the refrigerant gas in the compression chamber 22 is compressed to a predetermined pressure and is discharged to the discharge chamber 41 via a corresponding discharge port 44 and discharge valve 45, which are formed in the valve plate assembly 13.

The inclination angle of the swash plate 18 is adjusted by changing the balance between the pressure in the compression chamber 22 and the pressure in the crank chamber 15 (crank pressure) that acts on each piston 21. In the preferred embodiment, the inclination angle of the swash plate 18 is adjusted by positively changing the crank pressure.

The compressor CP includes a supply passage 60 and a control valve 61. The supply passage 60 connects the discharge chamber 41 to the crank chamber 15. The control valve 61 is located in the supply passage 60. Adjustment of the opening degree of the control valve 61 controls the flow rate of highly pressurized refrigerant gas supplied from the discharge chamber 41 to the crank chamber 15 through the supply passage 60. This determines the crank pressure. The inclination angle of the swash plate 18 changes in accordance with the change in the crank pressure. Accordingly, the stroke of each piston 21, or the displacement of the compressor CP is adjusted. The crank mechanism of the preferred embodiment has a variable displacement structure that controls the displacement by adjusting the flow rate of the refrigerant gas delivered to the crank chamber.

When the opening degree of the control valve 61 is decreased to lower the crank pressure, the inclination angle of the swash plate 18 is increased. Accordingly, the displacement of the compressor CP is increased. Conversely, when the opening degree of the control valve 61 is increased to increase the crank pressure, the inclination angle of the swash plate 18 is decreased. Accordingly, the displacement of the compressor CP is decreased.

The rotary shaft 16 has a first end portion, or a front end portion 16*a*, projecting from the front housing 12 through a through hole 12*c* formed in a front wall 12*b* of the front housing 12. The front end portion 16*a* of the rotary shaft 16 is connected to a pulley 25 via a first one-way clutch 24 outside the front housing 12. The first one-way clutch 24 is rotated in one direction to permit power transmission from the pulley 25 to the rotary shaft 16 and prevent power from being transmitted from the rotary shaft 16 to the pulley 25.

A support cylinder 12*d* projects from the front wall 12*b* of the front housing 12 to rotatably support the pulley 25 via a radial bearing 26. The pulley 25 is connected to and driven by the engine Eg via a belt 27.

The rotary shaft 16 includes a second end, or a rear end portion 16*b*, projecting from the rear housing 14 through the through hole 14*a* of the rear housing 14. The rear end portion 16*b* of the rotary shaft 16 is connected to and driven by an electric motor 30.

The electric motor 30 is a DC electric motor incorporating a brush. A rotor 33, which forms part of the electric motor 30, is connected to the rear end portion 16*b* of the rotary shaft 16 via a radial bearing 31 and a second one-way clutch 32. The second one-way clutch 32 is rotated in one direction to permit power transmission from the rotor 33 to the rotary shaft 16 and prevent power from being transmitted from the rotary shaft 16 to the rotor 33.

In the preferred embodiment, the second one-way clutch 32 is press-fitted to the rotor 33 and connected to the rotary shaft 16 by a key. A step 16*c* is formed on the outer surface at the rear end portion 16*b* of the rotary shaft 16 to restrict movement of the rotor 33 in the frontward direction when connecting the rotor 33 to the rotary shaft 16. More specifically, the second one-way clutch 32 is moved frontward along the rotary shaft 16 to a position where it comes into contact with the step 16*c*. This facilitates positioning of the rotor 33 with respect to the rotary shaft 16.

The rotor 33 includes a coil 33*a* and a commutator 33*b*. An annular stator support 35 is attached to the rear outer surface of the rear housing 14. A stator (permanent magnet) 34, which forms part of the electric motor 30, is fixed to the stator support 35. The stator 34 encompasses the rotor 33 in the stator support 35. A brush 36, which slides along the commutator 33*b*, conducts power to the coil 33*a*. This causes the electric motor 30 to rotate the rotor 33. The brush 36 is supplied with power from an external power source via a drive circuit (not shown), which is fixed to the rear housing 14.

An electric motor case 37, which accommodates the electric motor 30, is fixed to the rear surface 14*b* of the rear housing 14 outside the compressor CP. The electric motor case 37 includes a plurality of ventilation holes 37*a* to release heat from the electric motor 30 out of the electric motor case 37.

The compressor CP of the preferred embodiment uses the engine Eg and the electric motor 30 as a drive source. In the preferred embodiment, when the engine Eg functions as the drive source and rotates the rotary shaft 16, the supply of power to the electric motor 30 is stopped. In this state, the second one-way clutch 32 prevents power from being transmitted from the rotary shaft 16 to the rotor of the electric motor 30. This prevents energy loss that would result from the rotation of the rotor 33. When the electric motor 30 rotates the rotary shaft 16 as the drive source, the first one-way clutch 24 prevents power from being transmitted from the rotary shaft 16 to the pulley 25. Accordingly, unnecessary power is not transmitted from the electric motor 30 to the engine Eg.

A first seal 50 is arranged in the through hole 12*c*, which extends through the front wall 12*b* of the front housing 12, to seal the space between the front end portion 16*a* of the rotary shaft 16 and the wall defining the through hole 12*c*. That is, the first seal 50 seals the inside of the compressor CP from the outside of the compressor CP at the front end portion 16*a* of the rotary shaft 16. The first seal 50 is a lip seal. A first lubrication chamber 51 is defined in the through hole 12*c* at the inner side of the first seal 50 (toward the right as viewed in FIG. 1). The first lubrication chamber 51 is located at the front side of the slide bearing portion 12*a* in the through hole 12*c*. The first lubrication chamber 51 is connected to the crank chamber 15 via a communication passage 58, which extends through the front wall 12*b* of the front housing 12.

A second seal 52 is arranged in the through hole 14*a* of the rear housing 14 to seal the space between the rear end portion 16*b* of the rotary shaft 16 and the wall defining the through hole 14*a*. That is, the second seal 52 seals the inside of the compressor CP from the outside of the compressor CP at the rear end portion 16*b* of the rotary shaft 16. The second seal 52 is a lip seal. A second lubrication chamber 53 is defined in the through hole 14*a* at the inner side of the second seal 52 (toward the left as viewed in FIG. 1). The second lubrication chamber 53 is located at the rear side of the valve plate assembly 13 in the through hole 14*a*.

The second lubrication chamber 53 is partitioned from the suction chamber 40. A restriction passage 54, which extends through a wall partitioning the second lubrication chamber 53 and the suction chamber 40, connects the second lubrication chamber 53 to the suction chamber 40.

A shaft passage 55 extends through the rotary shaft 16 along the axis L to connect the first lubrication chamber 51 and the second lubrication chamber 53. The shaft passage 55 has an inlet 55*a* extending from the shaft passage 55 to the surface of the rotary shaft 16. The inlet 55*a* is located in the first lubrication chamber 51 near the portion where the first seal 50 contacts the rotary shaft 16. The shaft passage 55 further has an outlet 55*b* extending from the shaft passage 55 to the surface of the rotary shaft 16. The outlet 55*b* is located in the second lubrication chamber 53 near the portion where the second seal 52 contacts the rotary shaft 16.

In the preferred embodiment, the communication passage 58, the first lubrication chamber 51, the shaft passage 55, the second lubrication chamber 53, and the restriction passage 54 form a refrigerant passage, which is used to adjust the crank pressure for controlling the compressor displacement. The crank pressure is determined by controlling the balance between the amount of the highly pressurized refrigerant gas supplied from the discharge chamber 41 to the crank chamber 15 via the supply passage 60 and the amount of refrigerant gas sent from the crank chamber 15 to the suction chamber 40 through the refrigerant passage. The refrigerant gas and the lubricating oil included in the refrigerant gas flows through the refrigerant passage from the crank chamber 15 to the suction chamber 40. This cools and lubricates the first and second seals 50 and 52.

The shaft passage 55 of the rotary shaft 16 includes an oil separator 56. The shaft passage 55, which has a predetermined diameter, is partially enlarged to form the oil separator 56. The oil separator 56 collects the lubricating oil on the wall of the shaft passage 55. A lubricating oil drain 56*a* extends through the rotary shaft 16 from the oil separator 56 to discharge the collected lubricating oil out of the oil separator 56 and into the crank chamber 15 (outside the rotary shaft 16).

The rotary shaft 16 has a front shaft piece, which includes the front end portion 16*a*, and a rear shaft piece, which includes the rear end portion 16*b*. The front and rear shaft pieces are welded together to form the rotary shaft 16. The line denoted by reference number 57 in FIG. 1 indicates the portion where the front and rear shaft pieces are connected to each other. Before the front and rear shaft pieces are connected to each other, the shaft pieces are drilled at the end faces corresponding to line 57 to form the shaft passage 55 (excluding the inlet 55*a* and the outlet 55*b*) and the oil separator 56.

The preferred embodiment has the advantages described below.

(1) The first lubrication chamber 51 is formed around the front end portion 16*a* of the rotary shaft 16 in the front housing 12. The second lubrication chamber 53 is formed around the rear end portion 16*b* of the rotary shaft 16 in the rear housing 14. Further, the crank chamber 15 is connected to the shaft passage 55 via the first lubrication chamber 51, and the shaft passage 55 is connected to the suction chamber 40 via the second lubrication chamber 53.

As a result, the refrigerant gas flows from the crank chamber 15 to the suction chamber 40 via the first lubrication chamber 51, the shaft passage 55, and the second lubrication chamber 53. This cools the first and second seals 50 and 52 in a satisfactory manner. Further, the lubricating oil included in the refrigerant gas lubricates the seals 50 and 52 in a satisfactory manner.

If the lubrication chambers 51 and 53 were to be connected by a passage that does not extend through the rotary shaft 16 like in the preferred embodiment, a passage would have to be formed avoiding components, such as the crank mechanism, and extending across the cylinder block 11. This would lengthen the passage and make the structure of the compressor housing complicated. However, in the preferred embodiment, the shaft passage 55 extends straight between the first and second lubrication chambers 51 and 53. This minimizes the distance between the lubrication chambers 51 and 53 and simplifies the compressor structure. The shortened distance between the lubrication chambers 51 and 53 improves the flow efficiency of the refrigerant gas between the lubrication chambers 51 and 53. This further increases the cooling efficiency and lubricating efficiency of the seals 50 and 52 and improves the controllability of the variable compressor displacement.

(2) The second lubrication chamber 53 and the suction chamber 40 are partitioned from each other but connected to each other by the restriction passage 54. Thus, the second seal 52 is less affected by the pressure fluctuation that occurs in the suction chamber 40 as the pistons 21 reciprocate in comparison to when the partitioning wall between the suction chamber 40 and the second lubrication chamber 53 is eliminated to use the suction chamber 40 as the second lubrication chamber 53 (or the second lubrication chamber 53 as the suction chamber 40). Accordingly, the second seal 52 stably seals the space between the rotary shaft 16 and the rear housing 14.

(3) The oil separator 56 is arranged in the shaft passage 55 of the rotary shaft 16 to separate lubricating oil from the refrigerant gas and provide the separated lubricating oil to the crank chamber 15. This prevents an excessive amount of lubricating oil from being supplied from the first lubrication chamber 51 to the second lubrication chamber 53. Accordingly, excessive amount of lubricating oil is prevented from being supplied to the suction chamber 40. This reduces the amount of lubricating oil discharged to the external refrigerant circuit 38 via the compression chambers 22 and the discharge chamber 41 while lubricating the crank chamber 15. The reduction in the amount of lubricating oil discharged to the external refrigerant circuit 38 improves heat exchange efficiency in the external refrigerant circuit 38.

It should be apparent to those skilled in the art that the present invention may be embodied in many other specific forms without departing from the spirit or scope of the invention. Particularly, it should be understood that the present invention may be embodied in the following forms.

Figure 2:
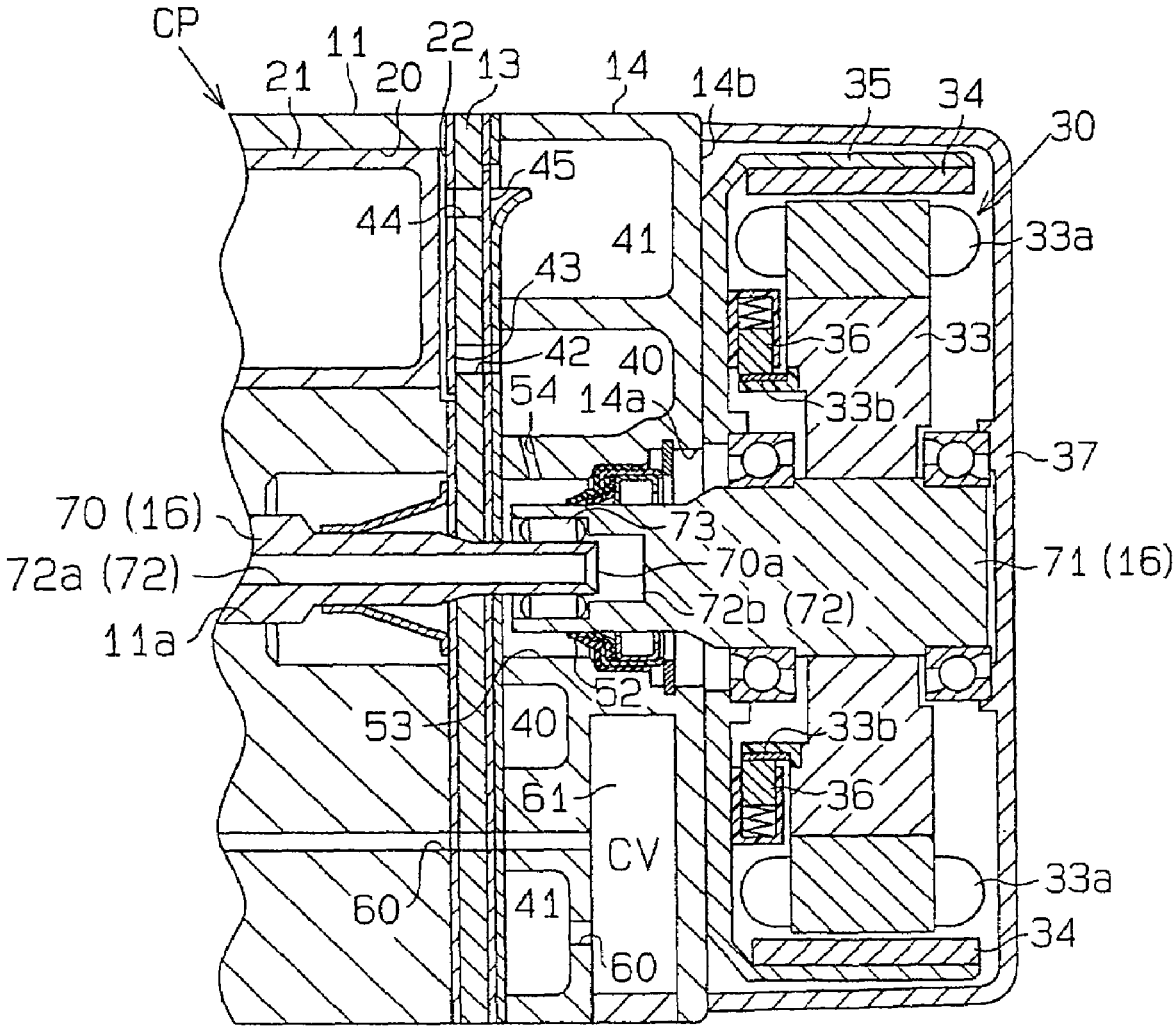
FIG. 2 is a schematic, partial cross-sectional view of a compressor according to a further embodiment of the present invention.

The rotary shaft 16 may be formed by a front shaft piece 70 and a rear shaft piece 71, as shown in FIG. 2.

In this structure, the front shaft piece 70 has a rear end portion arranged in the second lubrication chamber 53. A front passage 72*a* extends through the front shaft piece 70. In the same manner as the shaft passage 55 of the above embodiment, the front end (not shown) of the front passage 72*a* is connected to the first lubrication chamber 51. The rear end of the front passage 72*a* opens at the rear end face 70*a* of the front shaft piece 70.

The rear shaft piece 71 has a cylindrical front end portion, which is arranged in the second lubrication chamber 53 and which accommodates the rear end portion of the front shaft piece 70. The space in the front end portion of the rear shaft piece 71 defines a rear passage 72*b*. The front passage 72*a* and the rear passage 72*b* form a shaft passage 72.

The front shaft piece 70 and the rear shaft piece 71 are connected to each other via a one-way clutch 73, which is arranged between the inner surface of the rear shaft piece 71 and the outer surface of the front shaft piece 70. The one-way clutch 73 is rotated in one direction to permit power transmission from the rear shaft piece 71 to the front shaft piece 70 and prevents power from being transmitted from the front shaft piece 70 to the rear shaft piece 71. A rotor 33, which forms part of an electric motor 30, is fixed to the rear end portion of the rear shaft piece 71. This integrally rotates the rear shaft piece 71 and the rotor 33.

In this structure, the refrigerant gas in the first lubrication chamber 51 is drawn into the rear passage 72*b* of the rear shaft piece 71 via the front passage 72*a* of the front shaft piece 70 and then further drawn into the second lubrication chamber 53 through gaps formed in the one-way clutch 73. The flow of the refrigerant gas cools and lubricates the seals 50 and 52 and the one-way clutch 73.

In the preferred embodiment, the wall partitioning the suction chamber 40 and the second lubrication chamber 53 may be eliminated. In this case, the suction chamber 40 is used as the second lubrication chamber 53 (or the second lubrication chamber 53 is used as the suction chamber 40).

The oil separator 56 does not necessarily have to be employed.

The electric motor 30 is not restricted to a DC electric motor incorporating a brush. For example, a motor that incorporates a brush, such as a universal motor, or a rotary magnetic field type electric motor, such as an induction electric motor and a reluctance electric motor (including an SR electric motor), may be employed.

The electric motor 30 may be connected to the front end portion 16*a* of the rotary shaft 16, and the engine Eg may be connected to the rear end portion 16*b* of the rotary shaft 16.

Instead of the electric motor 30, a driven device, such as a dynamo, may be connected to the rotary shaft 16.

In the preferred embodiment, the compressor CP is a variable displacement compressor. However, the present invention may be applied to a compressor having a fixed displacement.

The present examples and embodiments are to be considered as illustrative and not restrictive, and the invention is not to be limited to the details given herein, but may be modified within the scope and equivalence of the appended claims.

What is claimed is:

1. A compressor, connected to an external refrigerant circuit, for compressing refrigerant gas, the compressor comprising:

a first housing;

a second housing;

a cylinder block having a bore, the cylinder block being arranged between the first and second housings;

a piston accommodated in the bore, the piston defining a compression chamber in the bore;

a rotatable rotary shaft extending through the first housing, the cylinder block, and the second housing, the rotary shaft having a first end portion and a second end portion;

a crank chamber defined in the first housing;

a crank mechanism, accommodated in the crank chamber, for converting rotation of the rotary shaft to reciprocation of the piston;

a suction chamber, defined in the second housing, for drawing in refrigerant gas from the external refrigerant circuit;

a first seal for sealing the first housing at the first end portion of the rotary shaft;

a second seal for sealing the second housing at the second end portion of the rotary shaft;

a first lubrication chamber defined by the first seal around the first end portion of the rotary shaft in the first housing;

a second lubrication chamber defined by the second seal around the second end portion of the rotary shaft in the second housing; and a shaft passage extending axially through the rotary shaft, the shaft passage being connected to the crank chamber via the first lubrication chamber and being connected to the suction chamber via the second lubricating chamber.

2. The compressor according to claim 1, wherein the refrigerant gas includes lubricating oil and flows from the crank chamber to the suction chamber via the first lubrication chamber, the shaft passage, and the second lubrication chamber, the compressor further comprising:

an oil separator, arranged in the shaft passage, for separating some of the lubricating oil from the refrigerant gas and collecting the separated lubricating oil.

3. The compressor according to claim 2, wherein the rotary shaft is formed by connecting two shaft pieces, the oil separator being defined at the location where the two shaft portions are connected.

4. The compressor according to claim 2, wherein the shaft passage has a predetermined diameter, and the oil separator is formed by enlarging the diameter of the shaft passage.

5. The compressor according to claim 2, wherein the oil separator discharges the separated lubricating oil to the crank chamber.

6. The compressor according to claim 5, further comprising:

a lubricating oil drain, connecting the oil separator and the crank chamber, for discharging the lubricating oil collected in the oil separator to the crank chamber.

7. The compressor according to claim 1, wherein the crank mechanism changes the stroke of the piston in accordance with the pressure of the crank chamber to vary the displacement of the compressor, the refrigerant gas flowing from the crank chamber to the suction chamber via the first lubricating chamber, the shaft passage, and the second lubricating chamber to adjust the pressure of the crank chamber.

8. The compressor according to claim 7, wherein the second lubrication chamber is partitioned from the suction chamber but connected to the suction chamber by a restriction passage.

9. The compressor according to claim 1, wherein the first end portion of the rotary shaft projects from the first housing, and the second end portion of the rotary shaft projects from the second housing, one of the first end portion and the second end portion being connected to an engine of a vehicle, and the other one of the first end portion and the second end portion being connected to an electric motor.

10. An air conditioner for use in a vehicle, the air conditioner comprising:

a refrigerant circuit; and a compressor, connected to the refrigerant circuit, for compressing refrigerant gas, the compressor including:

a first housing;

a second housing;

a cylinder block having a bore, the cylinder block being arranged between the first and second housings;

a piston accommodated in the bore, the piston defining a compression chamber in the bore;

a rotatable rotary shaft extending through the first housing, the cylinder block, and the second housing, the rotary shaft having a first end portion and a second end portion;

a crank chamber defined in the first housing;

a crank mechanism, accommodated in the crank chamber, for converting rotation of the rotary shaft to reciprocation of the piston;

a suction chamber, defined in the second housing, for drawing in refrigerant gas from the refrigerant circuit;

a first seal for sealing the first housing at the first end portion of the rotary shaft;

a second seal for sealing the second housing at the second end portion of the rotary shaft;

a first lubrication chamber defined by the first seal around the first end portion of the rotary shaft in the first housing;

a second lubrication chamber defined by the second seal around the second end portion of the rotary shaft in the second housing; and a shaft passage extending axially through the rotary shaft, the shaft passage being connected to the crank chamber via the first lubrication chamber and being connected to the suction chamber via the second lubricating chamber.

11. The air conditioner according to claim 10, wherein the refrigerant gas includes lubricating oil and flows from the crank chamber to the suction chamber via the first lubrication chamber, the shaft passage, and the second lubrication chamber, the compressor further comprising:

an oil separator, arranged in the shaft passage, for separating some of the lubricating oil from the refrigerant gas and collecting the separated lubricating oil.

12. The air conditioner according to claim 11, wherein the rotary shaft is formed by connecting two shaft pieces, the oil separator being defined at the location where the two shaft portions are connected.

13. The air conditioner according to claim 11, wherein the shaft passage has a predetermined diameter, and the oil separator is formed by enlarging the diameter of the shaft passage.

14. The air conditioner according to claim 11, wherein the oil separator discharges the separated lubricating oil to the crank chamber.

15. The air conditioner according to claim 14, further comprising:

a lubricating oil drain, connecting the oil separator and the crank chamber, for discharging the lubricating oil collected in the oil separator to the crank chamber.

16. The air conditioner according to claim 10, wherein the crank mechanism changes the stroke of the piston in accordance with the pressure of the crank chamber to vary the displacement of the compressor, the refrigerant gas flowing from the crank chamber to the suction chamber via the first lubricating chamber, the shaft passage, and the second lubricating chamber to adjust the pressure of the crank chamber.

17. The air conditioner according to claim 16, wherein the second lubrication chamber is partitioned from the suction chamber but connected to the suction chamber by a restriction passage.

18. The air conditioner according to claim 10, wherein the first end portion of the rotary shaft projects from the first housing, and the second end portion of the rotary shaft projects from the second housing, one of the first end portion and the second end portion being connected to an engine of the vehicle, and the other one of the first end portion and the second end portion being connected to an electric motor.

19. A compressor, connected to an external refrigerant circuit, for compressing refrigerant gas, the compressor comprising:

a first housing;

a second housing;

a cylinder block having a bore, the cylinder block being arranged between the first and second housings;

a piston accommodated in the bore, the piston defining a compression chamber in the bore;

a rotatable rotary shaft extending through the first housing, the cylinder block, and the second housing, the rotary shaft having a first end portion and a second end portion, the rotary shaft being formed by connecting two shaft pieces;

a crank chamber defined in the first housing;

a crank mechanism, accommodated in the crank chamber, for converting rotation of the rotary shaft to reciprocation of the piston;

a suction chamber, defined in the second housing, for drawing in refrigerant gas from the external refrigerant circuit;

a first sealing means for sealing the first housing at the first end portion of the rotary shaft;

a second sealing means for sealing the second housing at the second end portion of the rotary shaft;

a first lubrication chamber defined by the first sealing means around the first end portion of the rotary shaft in the first housing;

a second lubrication chamber defined by the second sealing means around the second end portion of the rotary shaft in the second housing;

a shaft passage extending axially through the rotary shaft and having a predetermined diameter, the shaft passage being connected to the crank chamber via the first lubrication chamber and being connected to the suction chamber via the second lubricating chamber, the refrigerant gas including lubricating oil and flowing from the crank chamber to the suction chamber via the first lubrication chamber, the shaft passage, and the second lubrication chamber;

an oil separator, arranged in the shaft passage, for separating some of the lubricating oil from the refrigerant gas and collecting the separated lubricating oil, the oil separator being formed by enlarging the diameter of the shaft passage and discharging the separated lubricating oil to the crank chamber; and a lubricating oil drain, connecting the oil separator and the crank chamber, for discharging the lubricating oil collected in the oil separator to the crank chamber.

20. The compressor according to claim 19, wherein the second lubrication chamber is partitioned from the suction chamber but connected to the suction chamber by a restriction passage.

* * * * *